United States Patent [19]

Motai et al.

[11] Patent Number: 4,829,938

[45] Date of Patent: May 16, 1989

[54] EXHAUST BOILER

[75] Inventors: Toshiki Motai; Masamichi Kashiwazaki, both of Tokyo, Japan

[73] Assignee: Mitsubishi Jukogyo Kabushiki Kaisha, Tokyo, Japan

[21] Appl. No.: 241,574

[22] Filed: Sep. 8, 1988

[30] Foreign Application Priority Data

Sep. 28, 1987 [JP] Japan ..... 62-240877

[51] Int. Cl.[4] ..... F22D 1/00

[52] U.S. Cl. ..... 122/716; 60/39.182; 122/470

[58] Field of Search ..... 122/7 R, 470, 421; 60/39.12, 39.5

[56] References Cited

U.S. PATENT DOCUMENTS 2,020,686 11/1935 Kaiser ..... 122/20 B 4,693,213 9/1987 Yanai et al ..... 122/7 R 4,706,612 11/1987 Moreno et al. ..... 122/7 R 4,738,224 4/1988 Brückner et al. ..... 122/7 R

*Primary Examiner*—Edward G. Favors

[57] ABSTRACT

An exhaust boiler includes a high-pressure superheater, a high-pressure steam generator, a high-pressure economizer, a low-pressure steam generator and a low-pressure economizer disposed sequentially from an upstream side within an exhaust gas flow passageway, and a denitrification apparatus is disposed upstream of the high-pressure economizer. Such boiler is improved so as to achieve maximum heat recovery regardless of whether or not sulfur oxides are contained in the exhaust gas. A bypass duct is connected to the exhaust gas passageway at a position downstream of the high-pressure economizer and upstream of the low-pressure steam generator, and dampers are disposed respectively within the bypass duct and at a position within the exhaust gas passageway downstream of the connecting point of the bypass duct and upstream of the low-pressure steam generator.

3 Claims, 5 Drawing Sheets

EXHAUST BOILER

BACKGROUND OF THE INVENTION

1. Field of the Invention:

The present invention relates to improvements in an exhaust boiler in which steam is generated by making use of an exhaust gas of a gas turbine using natural gas or heavy oil as fuel as a heat source, and which is of the type that a denitrification apparatus is assembled therein.

2. Description of the Prior Art

In order to reduce $NO_x$ (nitrogen oxides) in an exhaust gas of a gas turbine, frequently a denitrification apparatus was assembled in an exhaust boiler. FIG. 3 is a system diagram showing one example of such exhaust boilers in the prior art, FIG. 5 is a diagram showing temperatures at the respective portions in the exhaust boiler, and in FIG. 3 reference numeral 20 designates an exhaust gas flow passageway, numeral 1 designates a superheater, numeral 2 designates a high-pressure steam generator, numeral 3 designates a denitrification apparatus, numeral 4 designates a high-pressure economizer, numeral 5 designates a low-pressure steam generator, numeral 6 designates a low-pressure economizer, numeral 7 designates an ammonia injection system and numeral 8 designates a stack.

However, as a result of the assembly of the denitrification apparatus 3, unreacted ammonia always would be generated in the section of the denitrification apparatus. Consequently, in the case where a sulfur content is contained in the fuel of the gas turbine, heat absorption is allowed only up to the temperature region where acidic ammonium sulfate produced from $SO_2$ in the combustion gas and the unreacted ammonia can exist stably in a solid phase. (It is said that acidic ammonium sulfate is present in a liquid phase at a temperature of 150° C. or lower when a molecular ratio is $NH_3/H_2SO_4 \leqq 1.1$. If this acidic sulfate is present in a liquid phase within an exhaust boiler tube, this would serve as a binder and dust or the like in the exhaust gas would secure to the heat transfer tube, resulting not only in deterioration of the heat transfer effect of the tube but also draft loss of the exhaust boiler, and sometimes reduction of the output of the gas turbine would result. In addition, there is a problem of corrosion of the heat transfer tube caused by ammonium sulfate in the liquid phase.)

Accordingly, in the prior art, in an exhaust boiler for a gas turbine in which fuel not containing a sulfur content and fuel containing a sulfur content are burnt either individually or in mixture, in, view of the above countermeasure for avoiding acidic ammonium sulfate in the liquid phase, only an exhaust boiler having a heat transfer surface arrangement such that the exhaust gas is discharged at such a high gas temperature that acidic ammonium sulfate is present in a solid phase (a temperature above the dashed line in FIG. 5) could be contemplated. More particularly, while the heat transfer surface arrangement as shown in FIG. 3 was allowed in the case where the problem of acidic ammonium sulfate was not present, in the case where the problem of acidic ammonium sulfate was present, one was compelled to employ the heat transfer surface arrangement as shown in FIG. 4. In FIG. 4, reference numeral 31 designates a high-pressure steam drum, numeral 32 designates a high-pressure saturated steam tube, numeral 33 designates a circulation pump, numeral 34 designates a mixer, and numeral 35 designates a condensed water line.

In order to raise the temperature at the highpressure economizer 4, condensed water and water from the high-pressure steam drum 31 are mixed in this mixer 34. As another method for raising the inlet temperature of the high-pressure economizer 4, a method of heating by steam is known. In that case, in place of the system of the circulation pump 33 in FIG. 4, a steam turbine extraction system or a high-pressure main steam system would be led to the mixer 34.

In the case where fuel containing a sulfur content and fuel not containing a sulfur content were respectively and individually burnt in the same gas turbine, in the prior art a heat transfer surface arrangement of an exhaust boiler was determined in view of a countermeasure for acidic ammonium sulfate. Accordingly, there was an inconvenience that even in the event that fuel not containing a sulfur content was employed, sufficient heat recovery could not be achieved because the heat transfer surfaces were fixed.

SUMMARY OF THE INVENTION

It is therefore one object of the present invention to provide an exhaust boiler which can always achieve maximum heat absorption regardless of whether or not sulfur oxides are present in the exhaust gas.

According to one feature of the present invention, there is provided an improved exhaust boiler of the type that a high-pressure superheater, a high-pressure steam generator, a high-pressure economizer, a low-pressure steam generator and a low-pressure economizer are disposed sequentially from the upstream side within an exhaust gas flow passageway, and a denitrification apparatus is disposed upstream of the high-pressure economizer, the improvements residing in that a bypass duct is connected to the exhaust gas passageway at a position downstream of the high-pressure economizer and upstream of the low-pressure steam generator, and that dampers are disposed respectively within the bypass duct and at a position within the exhaust gas passageway downstream of the connecting point of the bypass duct and upstream of the low-pressure steam generator.

In other words, there is provided a novel exhaust boiler having such a heat transfer surface arrangement and a duct system necessitated therefor that maximum heat recovery can be achieved respectively in separate manners depending upon whether the fuel used containing contains a sulfur content and hence sulfur oxides are contained in an exhaust gas or the fuel used does not contain a sulfur content, and hence sulfur oxides are not contained in the exhaust gas.

With the exhaust boiler according to the present invention as featured above, it becomes possible to achieve maximum heat recovery in the above cases employing different fuels.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
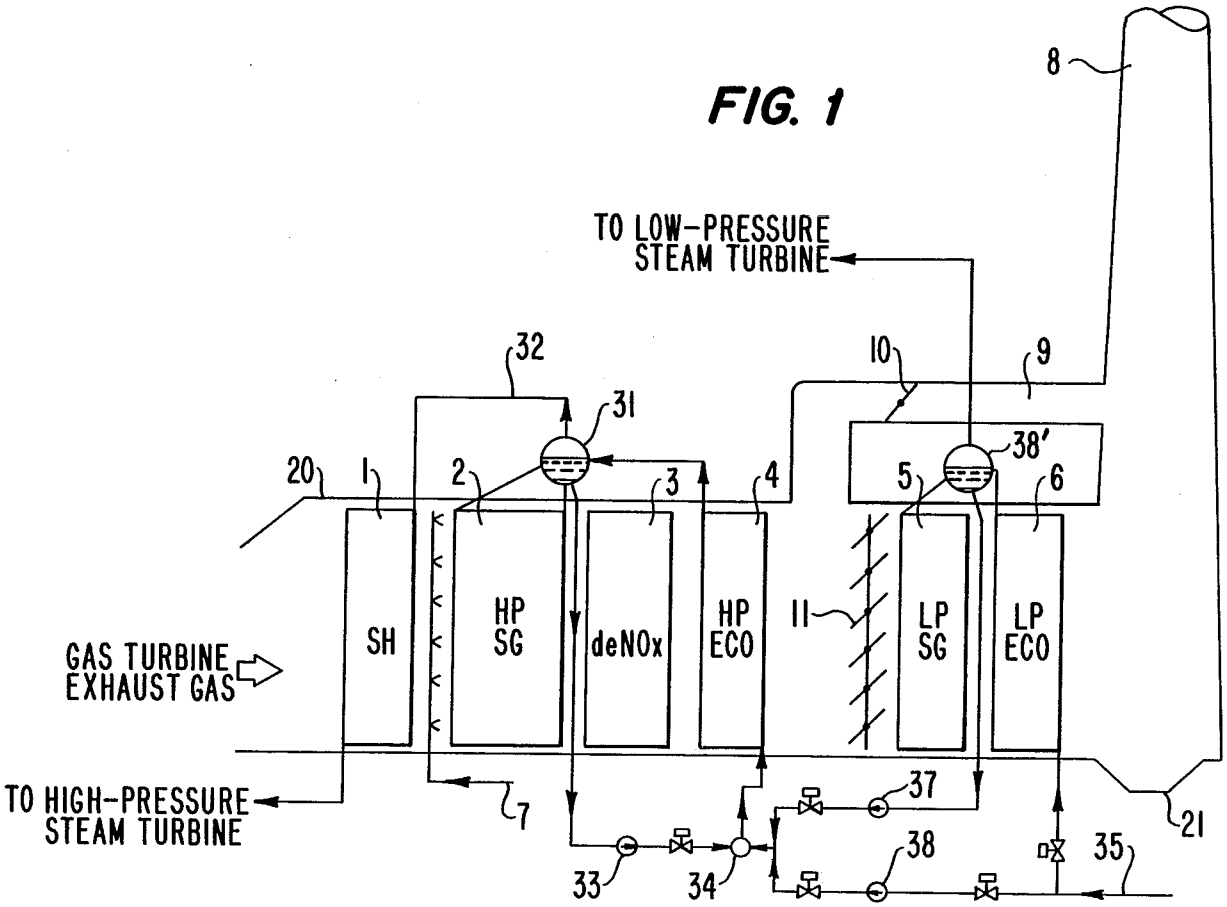
FIG. 1 is a schematic view showing one preferred embodiment of the present invention.

One preferred embodiment of the present invention now will be described with reference to FIG. 1. It is to be noted that component parts similar to those of the exhaust boiler in the prior art are given like reference numerals and detailed explanation thereof will be omitted.

In FIG. 1, reference numeral 38' designates a low-pressure steam drum, numeral 37 designates a highpressure feed pump, and numeral 38 designates a highpressure boost-up feed pump. Reference numeral 9 designates a bypass duct, which is connected to an exhaust gas flow passageway 20 at a position downstream of a highpressure economizer 4 and upstream of a low-pressure steam generator 5. Reference numeral 10 designates a damper disposed within the bypass duct 9, and numeral 11 designates another damper disposed within the exhaust gas flow passageway 20 at a position downstream of the connecting point of the bypass duct 9 and upstream of the low-pressure steam generator 5.

The passageway of exhaust gas of a gas turbine is divided in two after passing through the highpressure economizer 4. If a sulfur content is not contained in the fuel and there is no fear of acidic ammonium sulfate, the damper 11 is opened, while the damper 10 is closed, and thereby after heat recovery has been achieved in the low-pressure steam generator 5 and the low-pressure economizer 6, the exhaust gas is led to a stack 8. However, if a sulfur content is contained in the fuel, the damper 11 is closed, while the damper 10 is opened, and the exhaust gas itself is led directly to the stack 8.

It is to be noted that the high-pressure boost-up feed pump 38 is in a line to be used in the case of bypassing the low-pressure steam generator 5 and the low-pressure economizer 6. In the event that heat absorption in the low-pressure steam generator 5 and the low-pressure economizer 6 is not effected, a liquid temperature at the inlet of the high-pressure economizer 4 would become the condensed water temperature, and so, in order to raise this liquid temperature, the condensed water is mixed with the boiler water in the mixer 34 and heated up to a predetermined temperature. However, as an alternative method of heating in such case, a method of heating by steam, as described previously, also may be employed.

Figure 2:
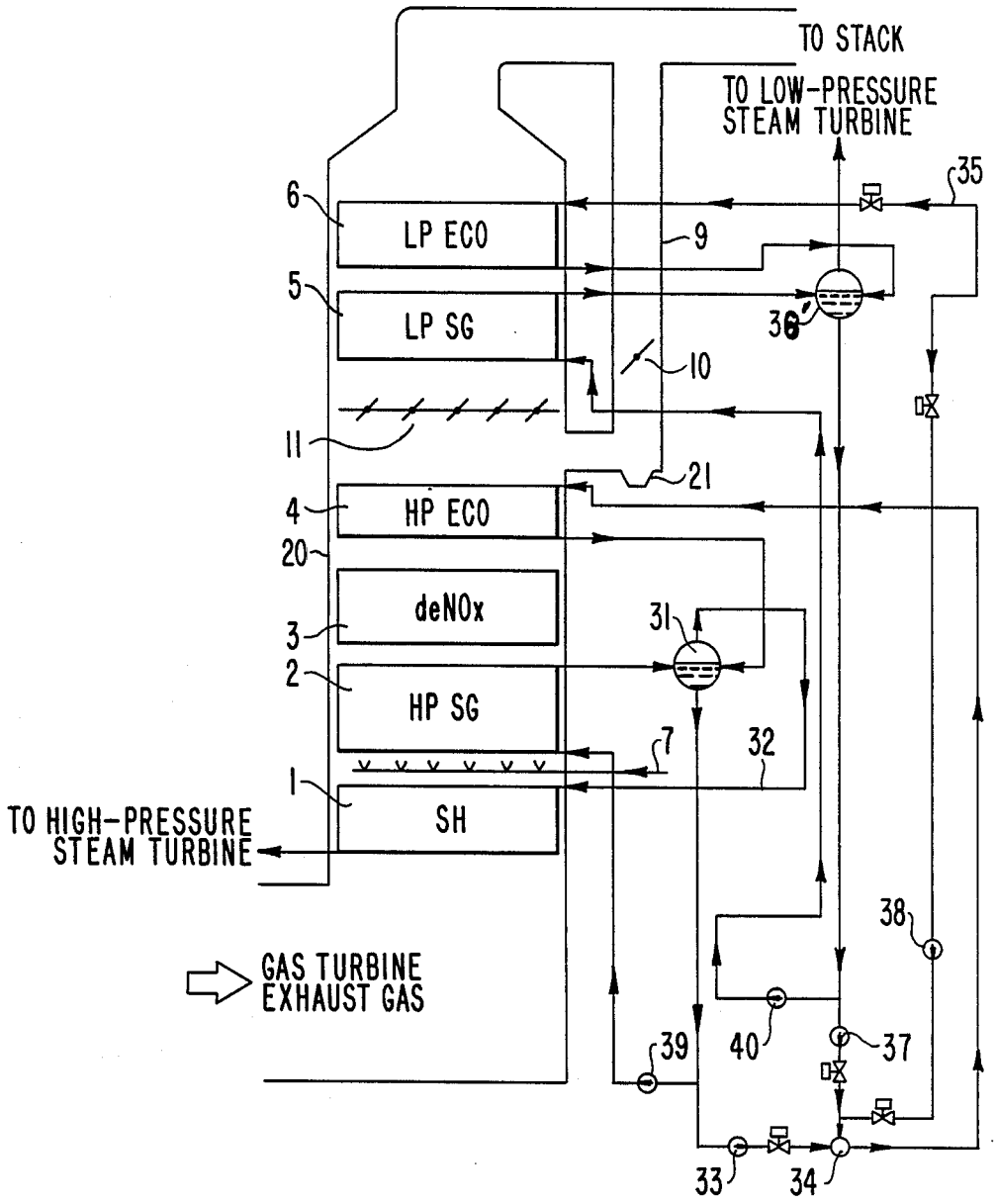
FIG. 2 is a schematic view showing another preferred embodiment of the present invention.
Figure 3:
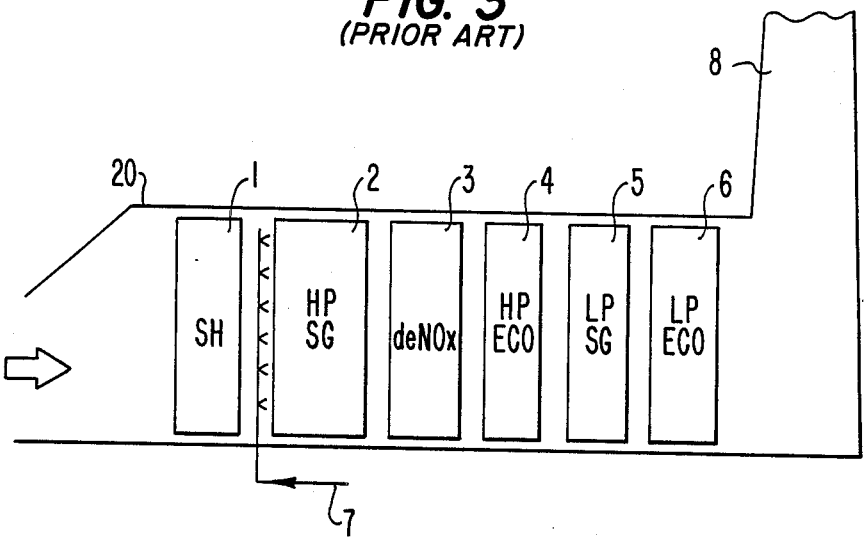
FIG. 3 (PRIOR ART)
FIGS. 3 and 4 are schematic views showing examples of exhaust boilers of the prior art.
Figure 4:
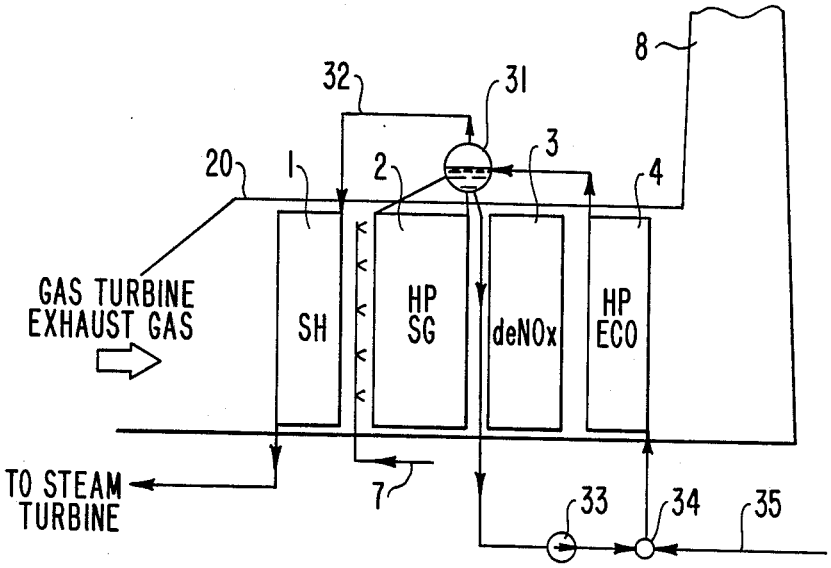
FIG. 4 (PRIOR ART)
Figure 5:
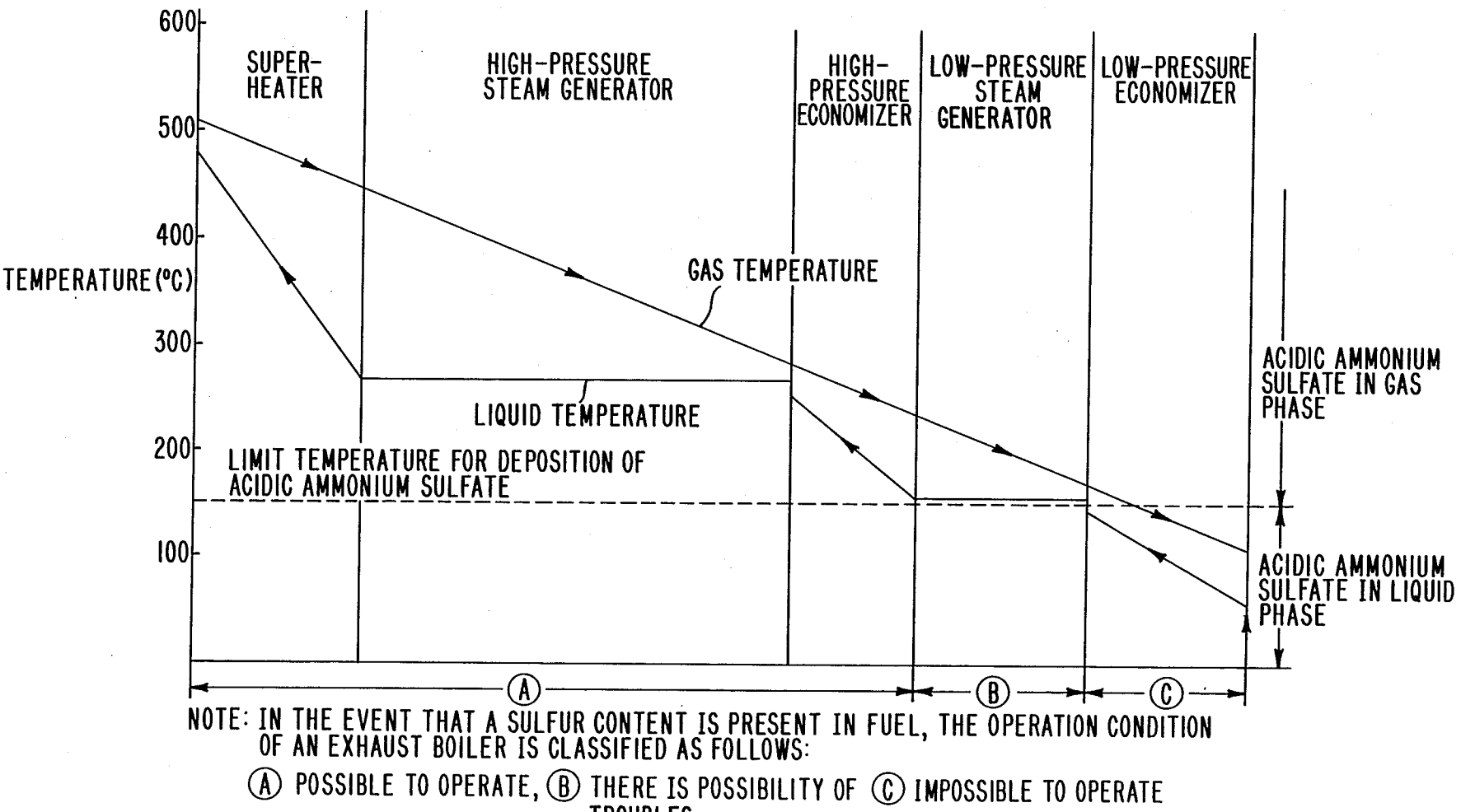
FIG. 5 is a diagram showing gas and liquid temperatures at the respective sections in the exhaust boiler.

The above-described embodiment is one embodiment of the present invention as applied to a horizontal gas flow type exhaust boiler. Another embodiment of the present invention as applied to a vertical gas flow type exhaust boiler is illustrated in FIG. 2. However, in this modified embodiment also, the basic technical concept (providing a bypass duct for the purpose of effecting heat absorption at heat transfer surfaces dependent on the type of fuel) is similar to the first preferred embodiment described above and illustrated in FIG. 1. In FIG. 2, reference numeral 39 designates a high-pressure boiler water circulating pump, and numeral 40 designates a low-pressure boiler water circulating pump.

As described in detail above, according to the present invention, it becomes possible to achieve maximum heat recovery regardless of whether or not a sulfur content is contained in the gas turbine fuel.

While the principle of the present invention has been described above in connection with preferred embodiments of the invention, it is intended that all matter contained in the above description and illustrated in the accompanying drawings shall be interpreted to be illustrative and not as a limitation to the scope of the invention.

What is claimed is:

1. In an exhaust boiler in which a high-pressure superheater, a high-pressure steam generator, a high-pressure economizer, a low-pressure steam generator and a low-pressure economizer are disposed sequentially from the upstream side within an exhaust gas flow passageway, and a denitrification apparatus is disposed upstream of said high-pressure economizer the improvement wherein:

a bypass duct is connected to said exhaust gas passageway at a position downstream of said high-pressure economizer and upstream of said low-pressure steam generator; and dampers are disposed respectively within said bypass duct and at a position within said exhaust gas passageway downstream of the connecting point of said bypass duct and upstream of said low-pressure steam generator.

2. An exhaust boiler as claimed in claim 1, wherein said exhaust boiler is of the horizontal flow type.

3. An exhaust boiler as claimed in claim 1, wherein said exhaust boiler is of the vertical flow type.

* * * * *